US011408304B2

(12) United States Patent
Lefebvre et al.

(10) Patent No.: US 11,408,304 B2
(45) Date of Patent: Aug. 9, 2022

(54) GAS TURBINE ENGINE BEARING HOUSING

(71) Applicant: PRATT & WHITNEY CANADA CORP., Longueuil (CA)

(72) Inventors: Guy Lefebvre, St-Bruno-de-Montarville (CA); Remy Synnott, St-Jean-sur-Richelieu (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 9 days.

(21) Appl. No.: 17/065,914

(22) Filed: Oct. 8, 2020

(65) Prior Publication Data

US 2022/0112819 A1 Apr. 14, 2022

(51) Int. Cl.
*F01D 25/16* (2006.01)
*F01D 25/28* (2006.01)

(52) U.S. Cl.
CPC ..... *F01D 25/162* (2013.01); *F01D 25/28* (2013.01); *F05D 2220/323* (2013.01); *F05D 2230/60* (2013.01); *F05D 2240/54* (2013.01); *F05D 2260/311* (2013.01)

(58) Field of Classification Search
CPC ..... F01D 25/16; F01D 25/162; F01D 25/164; F01D 25/28; F02C 7/06
See application file for complete search history.

(56) References Cited

U.S. PATENT DOCUMENTS 7,237,959 B2 * 7/2007 Bouchy ..... F01D 21/045 384/445
7,318,685 B2 * 1/2008 Bouchy ..... F01D 21/045 403/2
7,452,152 B2 * 11/2008 Bouchy ..... F01D 21/045 403/2
9,169,728 B2 10/2015 Wallace et al.
2004/0063504 A1 * 4/2004 Bouchy ..... F16P 5/005 464/32

(Continued)

FOREIGN PATENT DOCUMENTS

FR 2752024 A1 * 2/1998 ..... F16P 5/005

OTHER PUBLICATIONS

European Search Report issued in EP counterpart application No. 21201781.8 dated Mar. 2, 2022.

*Primary Examiner* — Topaz L. Elliott
(74) *Attorney, Agent, or Firm* — NORTON ROSE FULBRIGHT CANADA LLP.

(57) ABSTRACT

A gas turbine engine has a bearing housing mounted to structure linked to the engine mounting pads. The bearing housing has bearing housing flanges with bearing housing flange openings aligned with attachment flange openings of the structure. Some of the bearing housing flange openings are slots. A first group of fasteners extends through one of the attachment flange openings and through one of the bearing housing flange openings. A second group of fasteners extends through one of the attachment flange openings and through one of the slots. The first group of fasteners are sacrificial fasteners configured to fracture in response to a load on the bearing housing exceeding a fracture load. The bearing housing is displaceable relative to the structure after fracture of the sacrificial fasteners via the second group of the fasteners moving within and relative to respective ones of the slots.

20 Claims, 6 Drawing Sheets

(56) References Cited

U.S. PATENT DOCUMENTS

| | | | | |
|---|---|---|---|---|
| 2005/0117828 | A1* | 6/2005 | Bouchy | F01D 25/16 384/535 |
| 2005/0172608 | A1* | 8/2005 | Lapergue | F01D 21/045 60/226.1 |
| 2007/0081852 | A1* | 4/2007 | Bouchy | F16P 5/005 403/2 |
| 2011/0305567 | A1* | 12/2011 | Milfs | F01D 21/045 415/229 |
| 2014/0119893 | A1* | 5/2014 | Servant | F04D 19/002 415/123 |
| 2014/0165533 | A1* | 6/2014 | Eleftheriou | F02K 3/06 60/226.1 |
| 2016/0130975 | A1* | 5/2016 | Chilton | F01D 25/24 415/9 |
| 2017/0030221 | A1* | 2/2017 | Hopper | F02C 7/06 |
| 2018/0266276 | A1* | 9/2018 | Phillips | F01D 25/16 |
| 2020/0141280 | A1 | 5/2020 | Kusakabe | |

* cited by examiner

GAS TURBINE ENGINE BEARING HOUSING

TECHNICAL FIELD

The application relates generally to gas turbine engines and, more particularly, to bearing housings of gas turbine engines.

BACKGROUND

Bearings which support rotating components of gas turbine engines are housed in, and supported by, bearing housings. The bearing housings are mounted to the fixed structure of the gas turbine engine.

Bearing housings are designed to accommodate excess loads which act on the bearing and exceed normal operating loads. Such excess loads may result from a seizure of the bearing during operation of the gas turbine engine. Techniques are employed to interrupt these excess loads and confine them to the bearing housing, thereby preventing their transmission to the other structure of the gas turbine engine. These techniques may involve adding parts to the bearing housing and/or connected structure, which may increase engine part count and weight.

SUMMARY

There is disclosed a gas turbine engine mountable with engine mounting pads, the gas turbine engine comprising: a structure linked to the engine mounting pads and having attachment flanges distributed circumferentially about a center axis of the gas turbine engine, each attachment flange having an attachment flange opening; a bearing housing mounted to the structure and including a bearing supporting a rotatable shaft of the gas turbine engine, the bearing housing having bearing housing flanges distributed circumferentially about the center axis of the gas turbine engine, each bearing housing flange having a bearing housing flange opening aligned with the attachment flange opening of an attachment flange of the attachment flanges, some of the bearing housing flange openings being slots extending circumferentially about the center axis of the gas turbine engine; and fasteners including a first group of the fasteners and a second group of the fasteners different from the first group of the fasteners, each fastener of the first group of the fasteners extending through one of the attachment flange openings and through one of the bearing housing flange openings aligned with that attachment flange opening, each fastener of the second group of the fasteners extending through one of the attachment flange openings and through one of the slots aligned with that attachment flange opening, the first group of the fasteners being sacrificial fasteners defining a fracture load indicative of a resistance of the sacrificial fasteners to fracture, the sacrificial fasteners configured to fracture in response to a load on the bearing housing exceeding the fracture load, the bearing housing being displaceable relative to the structure after fracture of the sacrificial fasteners via the second group of the fasteners moving within and relative to respective ones of the slots.

There is disclosed a method of securing a bearing housing to a structure of a gas turbine engine linked to engine mounting pads, the method comprising: supporting a rotatable shaft of the gas turbine engine with a bearing of the bearing housing; placing the bearing housing against the structure to align mounting holes of the bearing housing with mounting holes of the structure, and to align mounting slots of the bearing housing with other mounting holes of the structure; and inserting a first group of fasteners through aligned pairs of the mounting holes, inserting a second group of fasteners through aligned pairs of the mounting slots and the other mounting holes, and tightening the first and second group of fasteners to secure the bearing housing to the structure, the first group of fasteners configured to fracture in response to a load on the bearing housing exceeding a fracture load of the first group of fasteners, the bearing housing being displaceable relative to the structure after fracture of the first group of fasteners via the second group of fasteners moving within and relative to respective ones of the mounting slots.

DESCRIPTION OF THE DRAWINGS

Reference is now made to the accompanying figures in which.

DETAILED DESCRIPTION

Figure 1A:
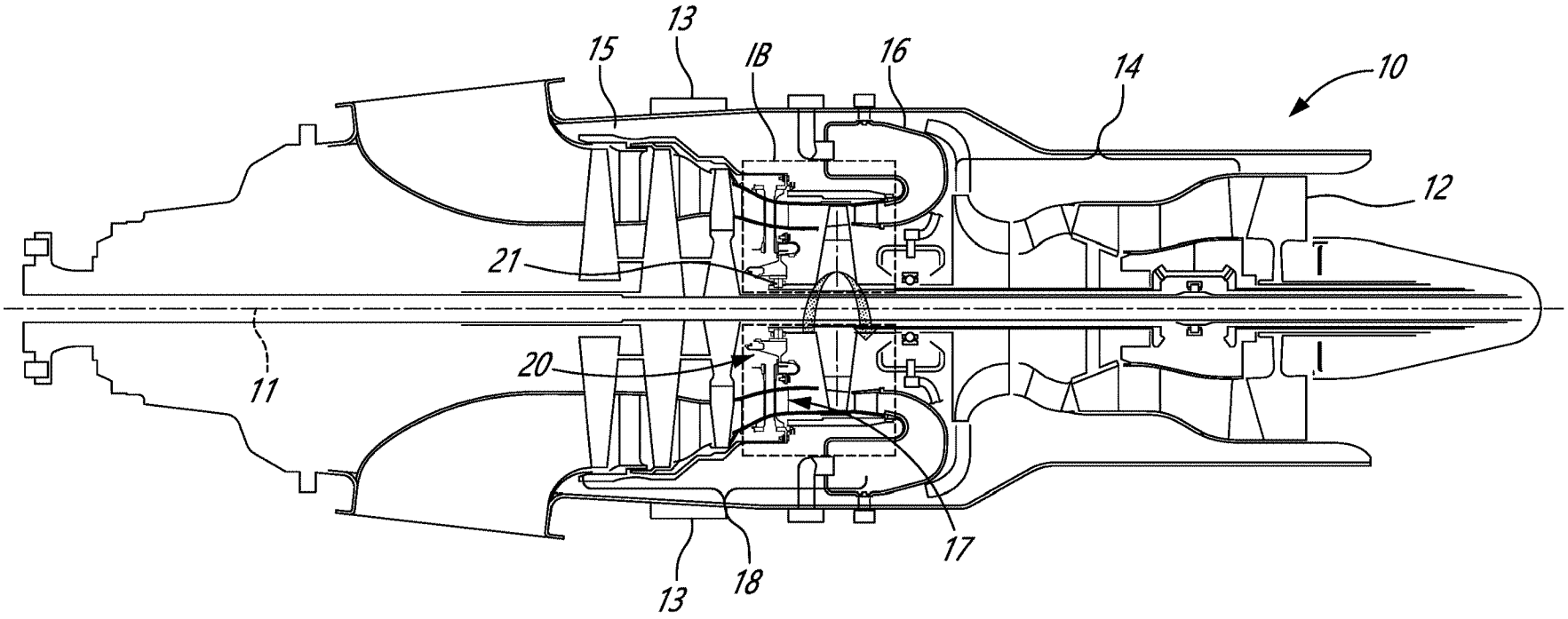
FIG. 1A is a schematic cross-sectional view of a gas turbine engine.

FIG. 1A illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. Components rotate about a longitudinal central axis 11 of the gas turbine engine 10.

One or more engine mounts, such as engine mounting pads 13, are used to mount the gas turbine engine 10 to adjacent structure so that there is no relative movement between the adjacent structure and the gas turbine engine 10. For example, in the configuration where the gas turbine engine 10 is mounted to an aircraft to provide propulsion thereto, the engine mounting pads 13 help to secure the gas turbine engine to appropriate mounts or anchors of the aircraft. The engine mounting pads 13 may be part of the gas turbine engine 10, or they may be part of the structure to which the gas turbine engine 10 is mounted. Irrespective of their configuration, the engine mounting pads 13 allow loads generated by the gas turbine engine 10 to be transmitted to the aircraft, for example. Referring to FIG. 1A, the engine mounting pads 13 are mounted along the periphery of the casing 15 of the gas turbine engine 10. The engine mounting pads 13 are circumferentially spaced apart from each other relative to the center axis 11 along the periphery of the casing 15.

Figure 1B:
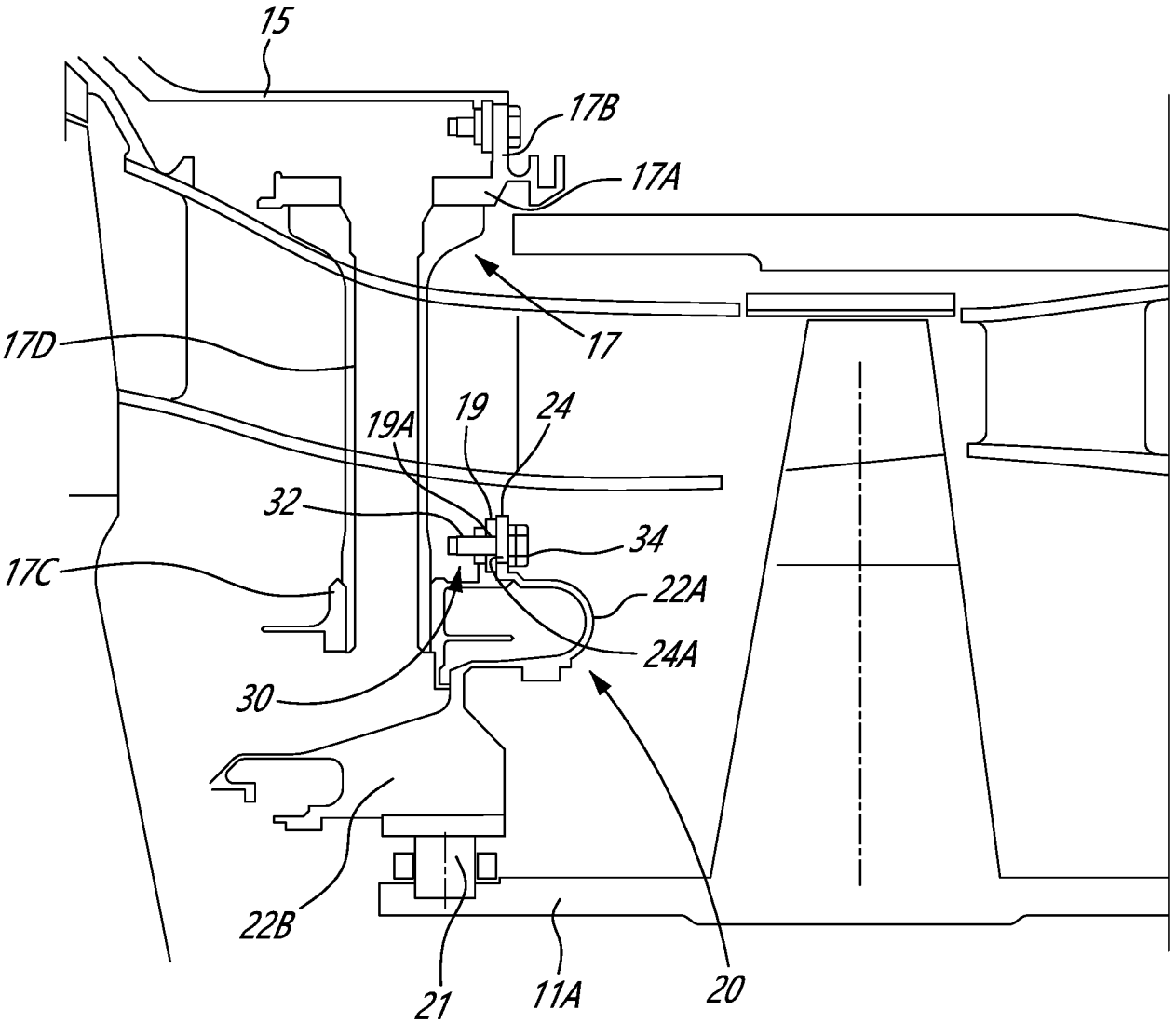
FIG. 1B is an enlarged view of portion IB in FIG. 1A.

Referring to FIGS. 1A and 1B, the gas turbine engine 10 has a bearing housing 20 and a structure 17, internal to the gas turbine engine 10, to mount the bearing housing 20 to the remainder of the gas turbine engine 10.

The structure 17 is structurally and mechanically linked to both the bearing housing 20 and to the remainder of the gas turbine engine 10. This allows loads generated at the bearing housing 20 by components thereof to be transmitted, via the structure 17, to the remainder of the gas turbine engine 10 and ultimately to the engine mounting pads 13. For example, in the illustrated embodiment, the structure 17 is structurally linked at a radially-outer end to the casing 15 of the gas turbine engine 10, and is thus indirectly structurally linked to the engine mounting pads 13.

Figure 2A:
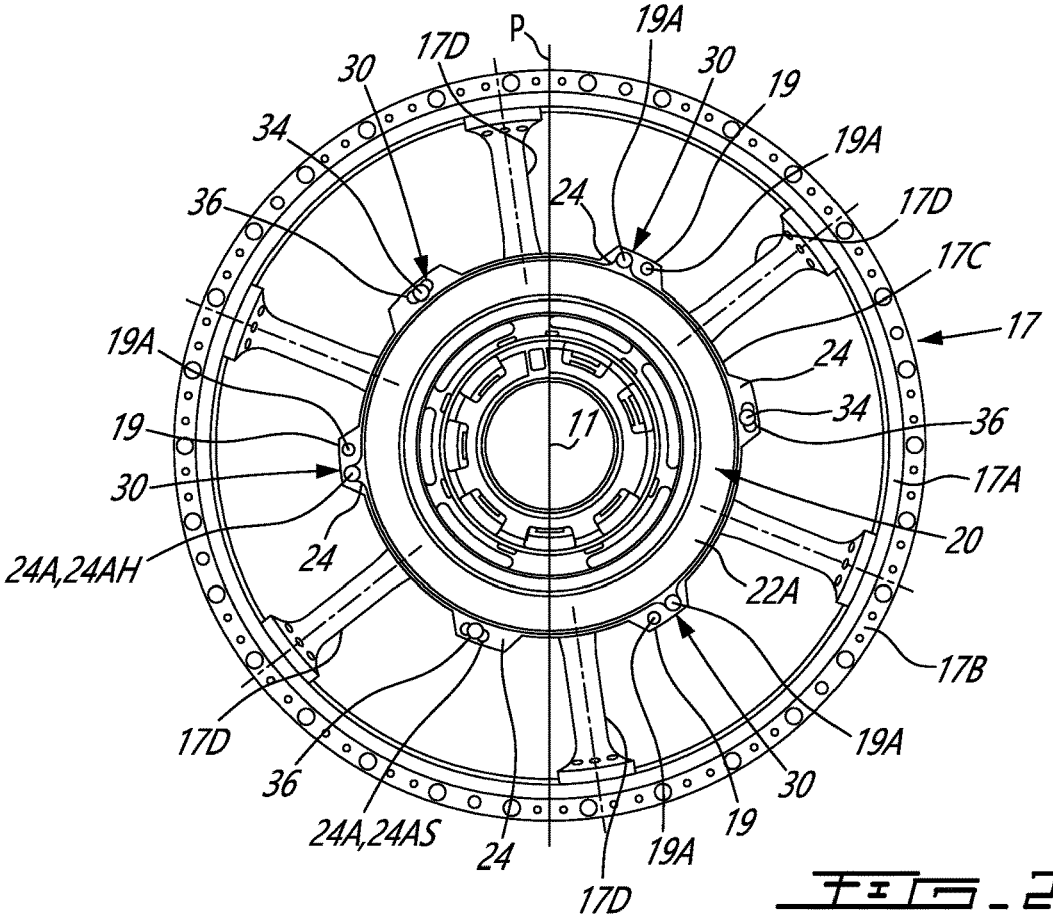
FIG. 2A is a front elevational view of a bearing housing and structure of the gas turbine engine of FIG. 1A.

FIGS. 1B and 2A illustrate one possible configuration of the structure 17 that achieves the functionality described above. The structure 17 is an annular body or ring that is used to mount components within an interior of the gas turbine engine 10 to the casing 15. The structure 17 extends radially inward from the casing 15 and radially inwardly past the gas path of the gas turbine 10. The structure 17 is an annular body that has an outer ring 17A defining a radially-outer flange 17B which is bolted to the casing 15, and an inner ring 17C disposed radially-inwardly (i.e. closer to the center axis 11) of the outer ring 17A. The inner ring 17C has attachment flanges 19 distributed circumferentially about the center axis 11 and spaced circumferentially apart from each other. The structure 17 has struts 17D distributed circumferentially about the center axis 11 and which extend radially between the outer and inner rings 17A,17C. The struts 17D are disposed circumferentially between the attachment flanges 19. In another configuration, the structure 17 is the casing 15 itself, such that the bearing housing 20 is structurally linked to the remainder of the gas turbine engine 10 by being attached to the casing 15. Other configurations for the structure 17 are possible and within the scope of the present disclosure for allowing the bearing housing 20 to be structurally linked to the remainder of the gas turbine engine 10.

The attachment flanges 19 may take any suitable shape or configuration which allows them to abut against corresponding structure of the bearing housing 20 to mount the structure 17 to the bearing housing 20. For example, in FIGS. 1B and 2A, each attachment flange 19 is a body that projects radially outwardly from a radially-outermost surface of the inner ring 17C. The body of the attachment flange 19 is discrete and separate from the body of another attachment flange 19. In FIGS. 1B and 2A, each attachment flange 19 is disposed on the radially-outer periphery of the inner ring 17C. Referring to FIG. 1B, each attachment flange 19 has an attachment flange opening 19A. The attachment flange openings 19A are apertures which extend in an axial direction (i.e substantially parallel to the center axis 11) through the axial thickness of the attachment flange 19. It will thus be appreciated that the attachment flanges 19 may be any structure which abuts against the corresponding structure of the bearing housing 20, protruding or not, peripheral or not, and which has the attachment flange openings 19A for mounting the structure 17 to the bearing housing 20. Referring to FIG. 2A, one or more of the attachment flanges 19 has two attachment flange openings 19A. The attachment flange openings 19A are spaced circumferentially apart from each other on the same attachment flange 19.

Referring to FIGS. 1B to 2B, the bearing housing 20 is positioned radially inward of the gas path of the gas turbine 10. The bearing housing 20 is positioned radially inward of the struts 17D of the structure 17. The bearing housing 20 is an annular body that defines a central cavity or volume to receive the bearing 21. Referring to FIG. 1B, the bearing 21 is fixedly mounted to a radially-inner portion of the bearing housing 20. The bearing 21 supports one of the rotatable shafts 11A of the gas turbine engine 10. In FIG. 1B, the shaft 11A is a high-pressure shaft which is driven by the rotation of a high pressure turbine of the turbine section 18. The bearing housing 20 is stationary with respect to the frame of reference of the gas turbine engine 10, and does not displace relative to the structure 17 or to the engine mounting pads 13. Referring to FIG. 1B, the annular body of the bearing housing 20 has an outer portion 22A with an extent along the axial direction, and an inner portion 22B disposed radially inwardly of the outer portion 22A and mounted to the bearing 21.

Referring to FIGS. 1B to 2B, the bearing housing 20 has bearing housing flanges 24 distributed circumferentially about the center axis 11 and spaced circumferentially apart from each other. The bearing housing flanges 24 may take any suitable shape or configuration which allows them to abut against corresponding features of the structure 17 to mount the bearing housing 20 to the structure 17. For example, in FIGS. 1B to 2B, each bearing housing flange 24 is a body that projects radially outwardly from a radially-outermost surface of the outer portion 22A of the bearing housing 20. The body of the bearing housing flange 24 is discrete and separate from the body of another bearing housing flange 24. In FIGS. 1B to 2B, each bearing housing flange 24 is disposed on the radially-outer periphery of the outer portion 22A. Each bearing housing flange 24 has a bearing housing flange opening 24A. The bearing housing flange openings 24A are apertures which extend in an axial direction (i.e substantially parallel to the center axis 11) through the axial thickness of the bearing housing flange 24. It will thus be appreciated that the bearing housing flanges 24 may be any structure which abuts against the corresponding portion of the structure 17, protruding or not, peripheral or not, and which has the bearing housing flange openings 24A for mounting the bearing housing 20 to the structure 17.

Each bearing housing flange opening 24A is aligned with one of the attachment flange openings 19A. The term "aligned" means that the openings 24A,19A overlap one another so that the attachment and bearing housing flanges 19,24 can be secured together, as described below, thereby securing the bearing housing 20 to the structure 17. In one possible configuration of the aligned relationship between the bearing housing flange and attachment flange openings 24A,19A, the center axes of the bearing housing flange and attachment flange openings 24A,19A are substantially collinear. In another possible configuration of the aligned relationship between the bearing housing flange and attachment flange openings 24A,19A, the bearing housing flange and attachment flange openings 24A,19A overlap axially. Referring to FIG. 2A, the attachment flange openings 19A and the bearing housing flange openings 24A are disposed asymmetrically about an upright plane P containing the center axis 11 of the gas turbine engine 10 and extending through the center axis 11. The center axis 11 lies in the upright plane P. The attachment and bearing housing flanges 19,24 are also disposed asymmetrically about the upright plane P. In an alternate embodiment, one or more of the aligned attachment and bearing housing flange openings 19A,24A and the attachment and bearing housing flanges 19,24 are disposed symmetrically about the upright plane P.

Figure 2B:
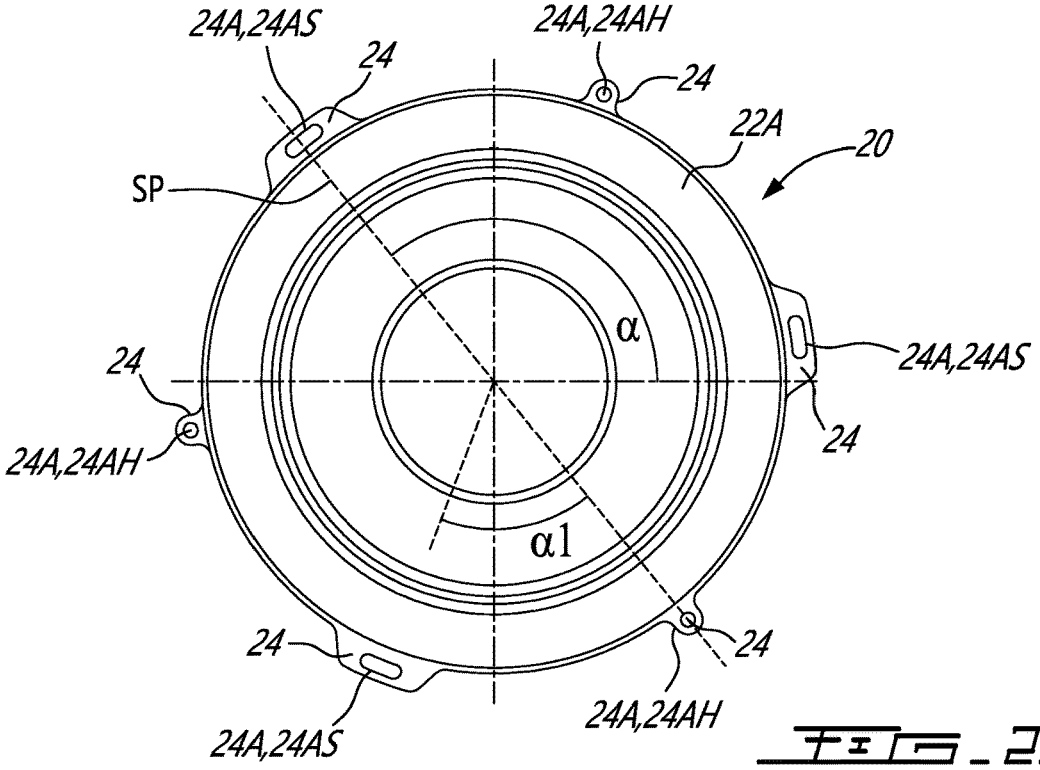
FIG. 2B is a front elevational view of part of the bearing housing of FIG. 2A.

Referring to FIG. 2B, the bearing housing flange openings 24A, and also the attachment flange openings 19A, may have a symmetric arrangement. The bearing housing 20 has a symmetry plane SP. The symmetry plane SP extends through the center axis 11, through one of the bearing housing flange openings 24A, and through another one of the bearing housing flange openings 24A that is positioned 180 degrees from, or circumferentially opposite to, the bearing housing flange opening 24A through which the symmetry plane SP extends. The bearing housing flange openings 24A on one side of the symmetry plane SP are symmetrically disposed relative to the bearing housing flange openings 24A on the other side of the symmetry plane SP. In FIG. 2B, there are two bearing housing flange openings 24A on each side of the symmetry plane SP, and each bearing housing flange opening 24A has a symmetrical disposed opposite bearing housing flange opening 24A on the other side of the symmetry plane SP.

Referring to FIGS. 2A and 2B, the bearing housing flange openings 24A are circumferentially spaced apart from each other about the center axis 11 and along a circumference of the bearing housing 20. The bearing housing flange openings 24A are circumferentially spaced apart from each other about the center axis by an angle $\alpha$1. The angle $\alpha$1 is the same between adjacent circumferentially-spaced bearing housing flange openings 24A. The angle $\alpha$1 may be equal to 360 degrees divided by the number of bearing housing flange openings 24A. In FIGS. 2A and 2B, the angle $\alpha$1 is thus 60 degrees (i.e. 360 degrees divided by three bearing housing flange openings 24A).

Referring to FIGS. 2A and 2B, the bearing housing flange openings 24A may vary in shape and size. One or more of the bearing housing flange openings 24A are holes 24AH, and one or more of the bearing housing flange openings 24A are slots 24AS. The holes 24AH are circular apertures of substantially constant diameter. The slots 24AS have a circumferential extent relative to the center axis 11. The slots 24AS are circumferentially elliptical apertures in the bearing housing flanges 24 that have a circumferential dimension greater in magnitude than a radial dimension. The number of bearing housing flange openings 24A that are holes 24AH and slots 24AS may vary. For example, in FIGS. 2A and 2B, some of the bearing housing flange openings 24A are holes 24AH and the remainder of the bearing housing flange openings 24A are slots 24AS. For example, in FIGS. 2A and 2B, three of the bearing housing flange openings 24A are holes 24AH, and three of the bearing housing flange openings 24A are slots 24AS. The bearing housing 20 in FIGS. 2A and 2B thus has two types of openings 24A—one pattern of three holes 24AH, and one pattern of three slots 24AS. If desired, the attachment flange openings 19A corresponding to the slots 24AS may also be slots. The presence of one or more slots 24AS allows the bearing housing 20 to displace circumferentially (e.g. "twist" or rotate) relative to the structure 17 when a circumferential off load (i.e. a torque) exceeds a threshold load, as described in greater detail below.

Different possible configurations of the slots 24AS may achieve the functionality described above. For example, referring to FIGS. 2A and 2B, the slots 24AS are circumferentially spaced apart from each other about the center axis 11 and along a circumference of the bearing housing 20. The slots 24AS are circumferentially spaced apart from each other about the center axis by an angle $\alpha$. The angle $\alpha$ is the same between adjacent circumferentially-spaced slots 24AS. The angle $\alpha$ may be equal to 360 degrees divided by the number of slots 24AS. In FIGS. 2A and 2B, the angle $\alpha$ is thus 120 degrees (i.e. 360 degrees divided by three slots 34AS).

Different possible configurations of the slots 24AS and their arrangement relative to the holes 24AH may achieve the functionality described above. For example, referring to FIGS. 2A and 2B, each of the holes 24AH and each of the slots 24AS are spaced circumferentially equally from an adjacent hole 24AH or slot 24AS. In an alternate embodiment, the holes 24AH and the slots 24AS are not circumferentially spaced equally from neighbouring or adjacent holes 24AH or slots 24AS. In such an embodiment, a pair of adjacent holes 24AH and slots 24AS may be circumferentially spaced closer to each other than they are spaced from the circumferentially adjacent pair of adjacent holes 24AH and slots 24AS. Referring to FIGS. 2A and 2B, the slots 24AS and the holes 24AH are disposed in alternating circumferential sequence about the center axis 11. Stated differently, each slot 24AS is circumferentially positioned between two holes 24AH, and each hole 24AH is circumferentially positioned between two slots 24AS. The slots 24AS and the holes 24AH thus alternate circumferentially among the bearing housing flanges 24. This alternating circumferential distribution of the slots 24AS and the holes 24AH may help in facilitating the circumferential displacement of the bearing housing 20 relative to the structure 17 in response to a significant load on the bearing 21. In an alternate embodiment, the slots 24AS and/or the holes 24AH are disposed circumferentially adjacent to each other, or may be circumferentially grouped together. Referring to FIGS. 2A and 2B, the number of holes 24AH is equal to the number of slots 24AS. In an alternate embodiment, the number of slots 24AS is less than, or greater than, the number of holes 24AH.

Figure 3:
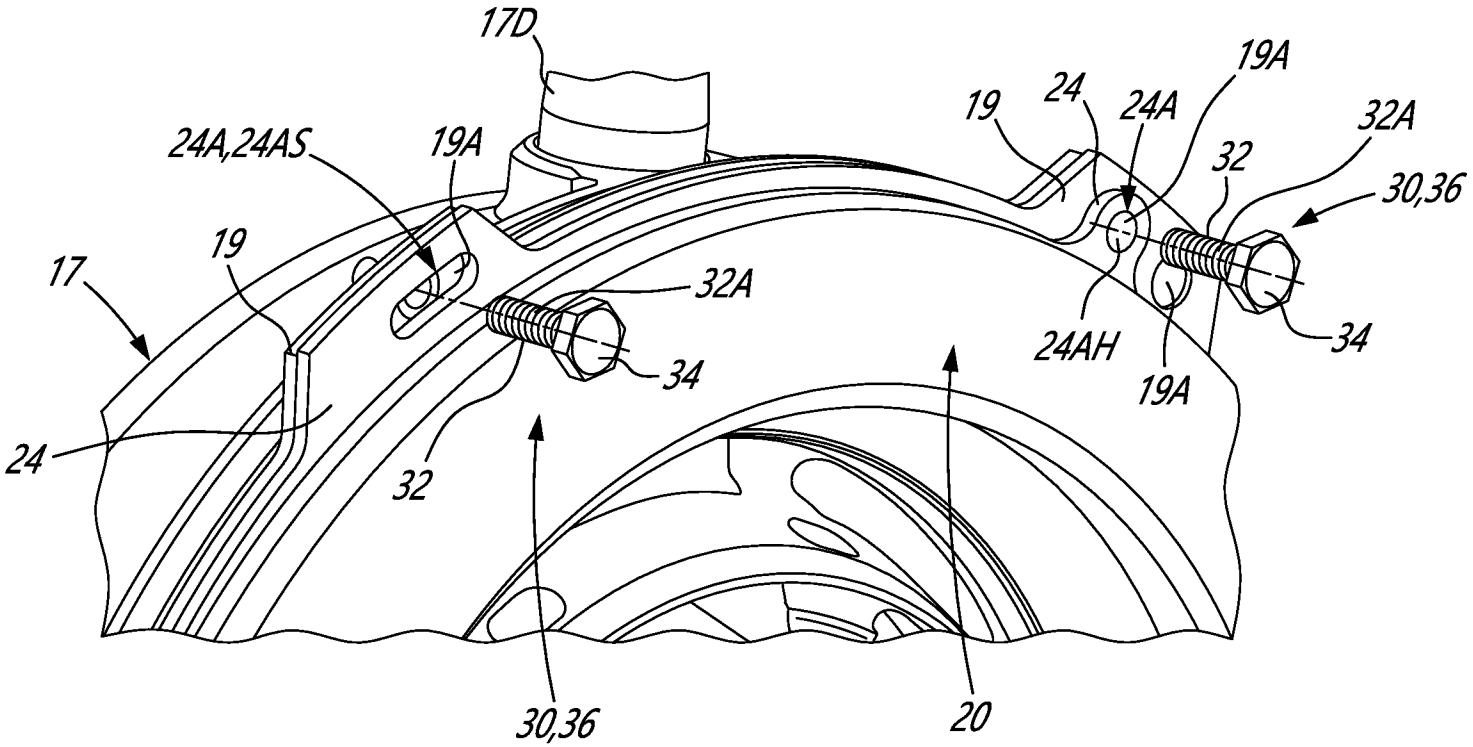
FIG. 3 is a perspective view of the bearing housing and the structure of the gas turbine engine of FIG. 1A.
Figure 4A:
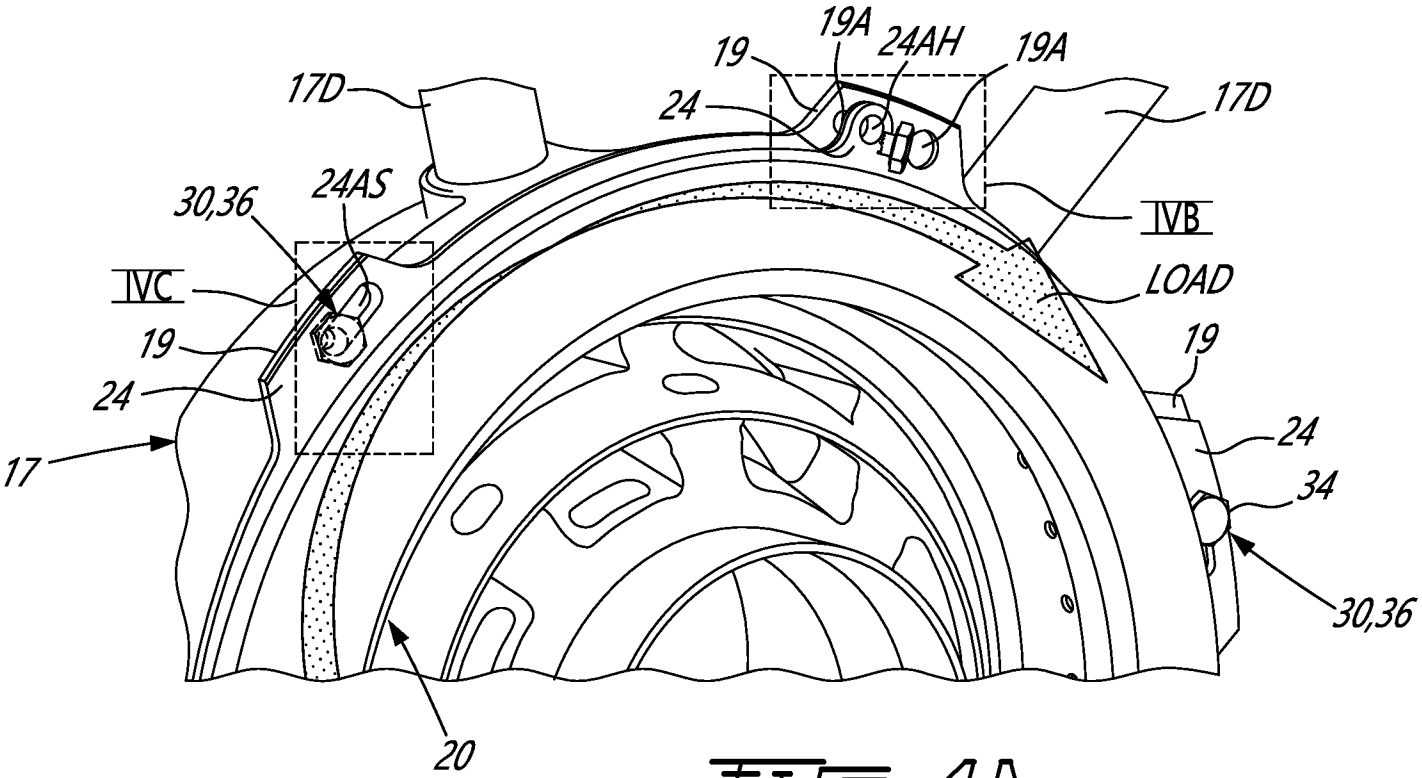
FIG. 4A is a perspective view of the bearing housing and the structure of the gas turbine engine of FIG. 1A in relative displacement.
Figure 4B:
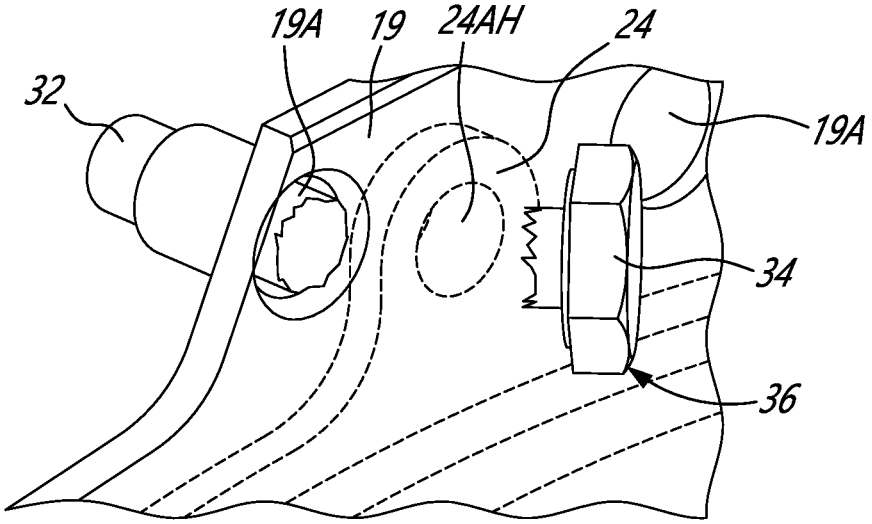
FIG. 4B is an enlarged view of portion IVB in FIG. 4A.
Figure 4C:
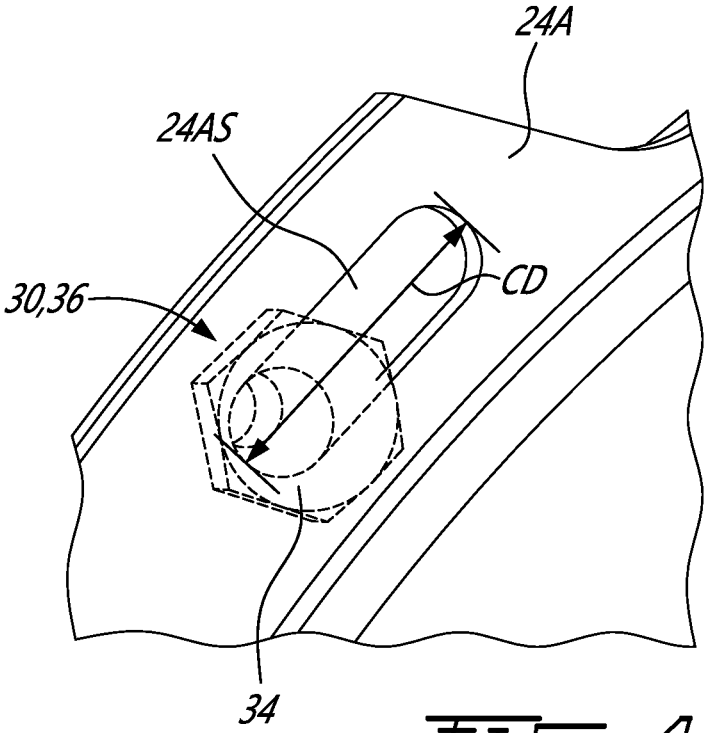
FIG. 4C is an enlarged view of portion IVC in FIG. 4A.

Referring to FIGS. 3 to 4C, there may be a relationship between the circumferential extent of the slots 24AS and the expected circumferential displacement of the bearing housing 20 (and thus the bearing housing flange 24) relative to the structure 17 (and the attachment flanges 19) in response to a significant load. The slots 24AS may have a circumferential extent related to a circumferential displacement of each hole 24AH relative to a corresponding attachment flange opening 19A when the bearing housing 20 circumferentially displaces relative to the structure 17. This relationship provides space for the slots 24AS and corresponding bearing housing flange 24 to circumferentially displace. In one possible configuration of this relationship, the circumferential dimension CD of each slot 24AS is equal to at least two times the diameter of the hole 24AH. In another possible configuration of this relationship, the circumferential dimension CD of each slot 24AS is a function of the expected maximum angular displacement of the bearing housing 20 relative to the structure 17 about the center axis 11. In another possible configuration of this relationship, the circumferential dimension CD of each slot 24AS is selected to allow for a failure of some of the fasteners securing the bearing housing 20 to the structure 17 before other fasteners might fail, as described in greater detail below. Other configurations of this relationship are also possible.

Referring to FIGS. 2A and 2B, each pair of aligned bearing housing flange and attachment flange openings 24A,19A receives a fastener 30 extending through the bearing housing flange and attachment flange openings 24A,19A and which can be tightened to secure the attachment and bearing housing flanges 19,24 together, thereby securing the bearing housing 20 to the structure 17. The fasteners 30 may be any suitable mechanical connection device or mechanism used to secure the bearing housing 20 to the structure 17. In the present disclosure, the fasteners 30 are described as bolts 30, but other types of fasteners 30 may also be used. In the present disclosure, all of the fasteners 30 are bolts 30, but it is possible for only some of the fasteners 30 to be bolts 30. Therefore, the disclosure and principles disclosed herein in relation to the bolts 30 apply as well to other types of mechanical fasteners 30 used to secure the bearing housing 20 to other structure 17 of the gas turbine engine 10.

Referring to FIG. 3, each bolt 30 has a shaft 32 having a threaded portion 32A and terminating at one of its ends with a bolt head 34. The shaft 32 of each bolt 30 extends through the entirety of the bearing housing flange opening 24A and through the entirety of the aligned attachment flange opening 19A. The free end of the shaft 32 opposite to the bolt head 34 is secured using any suitable device, such as a nut. As the nut and bolt head 34 are tightened, the nut is applied against attachment flange 19 and the bolt head 34 is applied against the bearing housing flange 24, thereby drawing the attachment and bearing housing flanges 19,24 together and securing the bearing housing 20 to the structure 17. In an alternative arrangement, the bolt head 34 is applied against the attachment flange 19 and the nut is applied against the bearing housing flange 24. In this alternative arrangement, tightening the nut and bolt head 34 also draws the attachment and bearing housing flanges 19,24 together and secures the bearing housing 20 to the structure 17. Referring to FIG. 2A, six bolts 30 are secured in six pairs of aligned bearing housing flange and attachment flange openings 24A,19A. Other configurations are possible. Fewer or more bolts 30 may be used. Referring to FIG. 2A, an even number of bolts 30 are used. An odd number of bolts 30 may be used in another configuration. One or more of the aligned bearing housing flange and attachment flange openings 24A,19A may be free of a bolt 30.

Referring to FIG. 1B, an off load may be generated against the bearing 21 during operation of the rotating parts of the gas turbine engine 10. The off load may be generated as a result of a sudden adverse engine event outside of normal engine operating conditions. Non-limiting examples of engine events that may generate the off load against the bearing 21 include a seizure of the bearing 21 due to insufficient lubrication, or the imbalance resulting from the loss of one or more rotor blades from a rotor supported by the shaft 11A and the bearing 21. The off load may travel along the following load path: to the bearing 21, then to the bearing housing 20, through the bolts 30, then to the structure 17 mounted to the bearing housing 20, then to the casing 15 or other structure of the gas turbine engine 10, and ultimately to the engine mounting pads 13.

The bolts 30 form the joint between the bearing housing 20 and the structure 17. The bolts 30 are thus configured to support loads generated by the bearing 21 during normal engine operating conditions. The bolts 30 are also part of the load path of the off load toward the engine mounting pads 13. If the off load is sufficiently large, it may travel along the load path all the way to the engine mounting pads 13 and may negatively impact the mounting of the gas turbine engine 10 to the adjacent structure.

Referring to FIG. 2A, to reduce or interrupt the transmission of the off load or an excess load to the engine mounting pads 13 via the structure 17, some or all of the bolts 30 are configured to fracture or break when the off load against the bearing 21 exceeds a fracture load of these bolts 30. These bolts 30 are referred to herein as sacrificial bolts 36 because they are made inoperative and unfit for further use after fracturing, and they absorb some of the off load. The fracturing of the sacrificial bolts 36 absorbs some or all of the off load and may reduce it sufficiently such that it will no longer negatively impact the engine mounting pads 13 or the mounting of the gas turbine engine 10 to the adjacent structure. The term "fracture" used herein refers to the sacrificial bolts 36 losing their structural integrity and thereby absorbing loads. For example, the sacrificial bolts 36 may break, crack, and/or shear in a plane perpendicular to a longitudinal axis of the shaft 32 in response to the off load.

The fracture load of the sacrificial bolts 36 is indicative of the resistance of the sacrificial bolts 36 to fracture. During normal operation of the gas turbine engine 10, the loads on the bearing housing 20 are lower than the fracture load of the sacrificial bolts 36 so that they remain intact. The fracture load is thus greater than the loads experienced by the bearing housing 20 during normal operation of the bearing 21. The fracture load may be selected based on an anticipated off load resulting from an adverse engine event, such as a bearing seizure. The magnitude of the anticipated off load may be known or may be approximately determined. The known magnitude of the anticipated off load may be determined to be that which avoids plastic deformation of the bearing housing 20 and/or the structure 17 when exposed to the anticipated off load. For example, finite element analysis (FEA) may be performed to determine the strength of the bearing housing 20, and thus what load will cause structural damage or plastic deformation of the bearing housing 20. Once the magnitude of the anticipated off load is known, the fracture load of the sacrificial bolts 36 may also be determined. The fracture load will be less than or equal to the anticipated off load, such that the sacrificial bolts 36 fracture when exposed to the anticipated off load. The fracture load may also be less than or equal to the anticipated load which may cause structural damage or plastic deformation of the bearing housing 20, such that the sacrificial bolts 36 fracture when exposed to such a load. The number, type and size of the sacrificial bolts 36, as well as the arrangement of the sacrificial bolts 36, may then be determined based on the known fracture load. The fracture load may result from the manufacture or material of the sacrificial bolts 30, and/or how and with what they are secured to the bearing housing 20 and the structure 17. The fracture load is a load defined collectively by the sacrificial bolts 36 when they secure the bearing housing 20 to the structure 17. For example, in one possible configuration, the fracture load is collectively defined by the sacrificial bolts 36 so that they will fracture first and before other bolts 30. It will be appreciated that fracture and off loads may have radial, axial, or torque/circumferential components, only one of these components, or any combination of these components.

By fracturing, the sacrificial bolts 36 allow for an important off load acting on the bearing 21 to be partially or fully absorbed by the bearing housing 20 and confined thereto, thereby helping to limit any damage to the gas turbine engine 10 or its mounting that might be caused by the off load. The sacrificial bolts 36 thus function similar in principle to a sacrificial electrical safety fuse. Since the sacrificial bolts 36 are also used to secure the bearing housing 20 to the structure 17, their additional "fuse" function of absorbing the off load allows for the use of already-present features of the bearing housing 20 to alleviate load transmission resulting from off loads on the bearing 21. Furthermore, in an embodiment, the sacrificial bolts 36 are the only mechanical features of the bearing housing 20 which perform this "fuse" function. This contributes to reducing or eliminating the need for extra parts on the bearing housing 20 to alleviate load transmission resulting from off loads on the bearing 21. The sacrificial bolts 36 may thus be a mechanical architecture that protects the engine mount structure's integrity during cases of off loads on the bearing 21 resulting from different engine failure events.

Different arrangements of sacrificial bolts 36 are possible to achieve the functionality described above. Referring to FIG. 2A, the bolts 30 include a first group of the bolts 30, and a second group of the bolts 30 which are different from the first group of the bolts 30. The bolts 30 of the second group are not the same bolts 30 as those in the first group 30. Each bolt 30 in the first group is secured through one of the attachment flange openings 19A and through one of the bearing housing flange openings 24A that is aligned with that attachment flange opening 19A. In FIG. 2A, each bolt 30 in the first group is secured through one of the holes 24AH of the bearing housing flanges 24. Each bolt 30 of the second group is secured in one of the attachment flange openings 19A and through one of the slots 24AS aligned with that attachment flange opening 19A.

Referring to FIG. 2A, in order to help partially or fully absorb the off load from the bearing 20 and confine it to the bearing housing 20, at least the bolts 30 of the first group are sacrificial bolts 36. The joint between the bearing housing 20 and the structure 17 thus has one or more failure modes. A first of these failure modes occurs when the sacrificial bolts 36 of the first group in the holes 24AH fracture to help partially or fully absorb the off load from the bearing 21, and interrupt its transmission to the engine mounting pads 13. In an embodiment, only the bolts 30 of the first group secured in the holes 24AH are sacrificial bolts 36, and a remainder of the bolts 30 remain intact when exposed to the off load. Thus only some of the bolts 30 are sacrificial bolts 36 configured to fracture in response to the off load exceeding the fracture load. The remaining bolts 30 may remain intact because they are in the slots 24AS, as explained in greater detail below. In this configuration, the sacrificial bolts 36 of the first group of bolts 30 are designed so that they alone will fracture when the bearing housing 20 experiences a significant off load. In another embodiment, described in greater detail below, the bolts 30 of the second group secured in the slots 24AS are also sacrificial bolts 36.

When the sacrificial bolts 36 of the first group have fractured, the bearing housing 20 is free to displace relative to the structure 17 as described above. After the sacrificial bolts 36 of the first group have fractured, the continued exposure of the bearing housing 20 to the off load may cause the slots 24AS of the bearing housing flanges 24 to displace relative to the bolts 30 of the second group secured in the slots 24AS, thereby causing the bearing housing 20 to displace relative to the structure 17. The slots 24AS are thus displaceable relative to the bolts 30 of the second group when the sacrificial bolts 36 fracture. Since the fracture load of the sacrificial bolts 36 may be less than or equal to the anticipated load which may cause structural damage or plastic deformation of the bearing housing 20, the bearing housing 20 may not experience structural damage or plastic deformation in response to the off load, and may thus displace relative to the structure without experiencing plastic deformation.

For example, when the sacrificial bolts 36 fracture in response to a significant torque acting against the bearing 21, the slots 24AS and their corresponding bearing housing flanges 24 may displace circumferentially relative to the bolts 30 of the second group secured in the slots 24AS and their corresponding attachment flange openings 19A. The slots 24AS may thus accommodate a circumferential displacement of the bearing housing 20 relative to the structure 17 while still allowing the bearing housing 20 to remain attached to the structure 17 when the sacrificial bolts 36 fracture in response to a significant torque acting against the bearing 21.

In the first failure mode where the second group of bolts 30 are configured to allow the bearing housing 20 to remain attached to the structure 17 upon fracture, the sacrificial bolts 36 of the first group of bolts 30 may fracture simultaneously. The significant off load from the bearing 21 may cause the sacrificial bolts 36 of the first group of bolts 30 to break, crack or rupture at substantially the same time. Such a simultaneous event may cause a physical effect that is detectable by a sensor or an observer. Such a simultaneous event may facilitate the displacement of the bearing housing 20 relative to the structure 17.

In one possible embodiment of the first failure mode where the bearing housing 20 remains attached to the structure 17 upon fracture, the first group of bolts 30 may include, or may be, only one sacrificial bolt 36. The single sacrificial bolt 36 may be in one of the holes 24AH, which may be the only hole 24AH of all the bearing housing flange openings 24A. The remainder of the bolts 30 of the second group are disposed in the remainder of the bearing housing flange openings 24A which are slots 24AS. For some applications where the anticipated off loads are relative low, the fracturing of this single sacrificial bolt 36 may be sufficient to interrupt or reduce the transmission of loads to the engine mounting pads 13. Since the remaining bolts 30 of the second group are secured in the slots 24AS and in their corresponding attachment flange openings 19A, the bearing housing 20 remains attached to the structure 17 when the single sacrificial bolt 36 fractures. The slots 24AS may also displace relative to their bolts 30 to help accommodate any circumferential displacement of the bearing housing 20 relative to the structure 17.

By helping some of the attachment and bearing housing flanges 19,24 remain connected after fracture of the sacrificial bolts 36, the bolts 30 of the second group may help to maintain the bearing's 21 support of the rotatable shaft 11A through an adverse engine event, and help to maintain alignment of the shaft 11A. Therefore, in the first failure mode where the sacrificial bolts 36 of the first group in the holes 24AH fracture to help partially or fully absorb the off load from the bearing 21, the bearing housing 20 and bearing 21 may continue to remain operational due to the presence of the bolts 30 of the second group secured in some of the attachment and bearing housing flanges 19,24.

In some instances, the fracturing of the sacrificial bolts 36 and the resulting possible displacement of the bearing housing 20 relative to the structure 17 may be sufficient to partially or fully absorb the off load from the bearing 21. However, in other instances where the off load is significant, the fracturing of the sacrificial bolts 36 and the resulting relative displacement of the bearing housing 20 may not be enough to reduce the off load transmitted to the engine mounting pads 13 to an acceptable level. In such instances, the bolts 30 of the second group secured in the slots 24AS may also be sacrificial bolts 36 configured to fracture, as explained in greater detail below. The bolts 30 of the second group in the slots 24AS thus provide another possibility for reducing or eliminating a torque off load before it is transmitted along the load path to the engine mounting pads 13. This is described herein as another, or second failure mode. In such an embodiment, the bearing housing 20 provides two "fuses" to break or reduce the transmission of problematic off loads to the structure mounting the gas turbine engine 10 to the adjacent structure. As described in greater detail below, the fracturing of the sacrificial bolts 36 of the second group may cause the bearing housing 20 to separate from the structure 17, thereby breaking the structural link between the bearing housing 20 and the engine mounting pads 13 and interrupting the load path of the off load. Thus, in an embodiment, the configuration of the bolts 30 requires two failure events or modes before the bearing housing 20 will decouple from the structure 17. The two failure modes also provide two occasions to interrupt the load off the bearing 21 before it reaches the engine mounting pads 13.

In the second failure mode where the second group of bolts 30 are also sacrificial bolts 36, the second group of the bolts 30 defines a second fracture load. In an embodiment, the first and second group of bolts 30 are identical bolts 30, and thus the fracture load of all the bolts 30 is the same. In an alternative embodiment, the second fracture load of the second group of the bolts 30 is different, either greater or less than, the fracture load of the first group of bolts 30. Thus, in the configuration where the bearing housing 20 has two failure modes, all of the bolts 30 are sacrificial bolts 36. Referring to FIG. 2A, the number of the sacrificial bolts 36 of the first group of bolts 30 is equal to the number of the sacrificial 36 of the second group of bolts 30. In FIG. 2A, there are six bolts 30. Three are the sacrificial bolts 36 of the first group of bolts 30, and three are the sacrificial bolts 36 of the second group of bolts 30. In an alternate embodiment, the number of the sacrificial bolts 36 of the first group of bolts 30 is more or less than the number of the sacrificial 36 of the second group of bolts 30.

Referring to FIGS. 3 to 4C, in the second failure mode where the first and second groups of bolts 30 are configured to allow the bearing housing 20 to separate from the structure 17 upon fracture, the sacrificial bolts 36 of the first and second groups of bolts 30 are secured in the holes 24AH, in the slots 24AS, and in their corresponding attachment flange openings 19A aligned therewith. The sacrificial bolts 36 are thus in both the holes 24AH and in the slots 24AS. Thus in this scenario, the two "fuses" of the bearing housing 20 are the sacrificial bolts 36 in the slots 24AS and in the holes 24AH. If the off load on the bearing 21 exceeds the fracture load of all the sacrificial bolts 36, all the sacrificial bolts 36 will fracture. The fracturing of all the sacrificial bolts 36 will absorb part of the excess off load, and the resulting separation of the bearing housing 20 from the structure 17 will break the transmission of the problematic loads to the engine mounting pads 13.

In the second failure more where the bearing housing 20 is configured to separate from the structure 17, the sacrificial bolts 36 of the second group may fracture simultaneously. The significant off load from the bearing 21 may cause the sacrificial bolts 36 of the second group of bolts 30 to break, crack or rupture at substantially the same time. Such a simultaneous event may cause a physical effect that is detectable by a sensor or an observer.

In the second failure mode, the sacrificial bolts 36 of the first group of bolts 30 are configured to fracture before the sacrificial bolts 36 of the second group of bolts 30 in response to the significant off load from the bearing 21. This sequential fracturing of the sacrificial bolts 36 provides two occasions for the bearing housing 20 to interrupt, reduce and/or confine part of the off load from the bearing 21 before it travels along the load path to the engine mounting pads 13. This sequential fracturing of the sacrificial bolts 36 provides a two or double fuse functionality. The significant off load from the bearing 21 may thus cause all the sacrificial bolts 36 to break, crack or rupture at spaced apart time intervals. Such a sequential event may cause two physical effects that are detectable by a sensor or an observer.

The sequential fracturing of the sacrificial bolts 36 may occur as follows. Referring to FIGS. 4A to 4C, in the event that a significant circumferential load or torque is applied to the bearing 21 that exceeds the fracture load of the sacrificial bolts 30, the sacrificial bolts 36 in the holes 24AH are configured to shear simultaneously in response to the significant torque. This may be considered to be a tripping of the first "fuse". Once the sacrificial bolts 36 of the first group of bolts 30 shear, the bearing housing 20 is free to rotate about the center axis 11 in response to the torque, and the slots 24AS and their bearing housing flanges 24 are displaced circumferentially relative to the sacrificial bolts 36 in the slots 24AS. The remaining intact sacrificial bolts 36 of the second group of bolts 30, which are in the slots 24AS, are then configured to shear simultaneously when the continued rotation of the bearing housing 20 causes the walls or edges delimiting the slots 24AS to abut against their sacrificial bolts 36 and shear the sacrificial bolts 36. This may be considered to be a tripping of the second "fuse", and allows for the bearing housing 20 to separate from the structure 17 and break the structural link between the bearing housing 20 and the engine mounting pads 13. The bearing housing 20 in the second scenario may thus be one that has a two-step sequential bearing seizure failure mode.

It will be understood that even if all of the bolts 30 are sacrificial bolts 36, the bearing housing 20 may still be configured to operate with a single failure mode. The fracturing of the sacrificial bolts 36 of the first group of bolts 30 and the resulting possible displacement of the bearing housing 20 relative to the structure 17 may be sufficient to partially or fully absorb the off load from the bearing 21, such that the sacrificial bolts 36 of the second group of bolts 30 may not fracture. Thus, the number of sacrificial bolts 36 in one or both of the holes 24AH and the slots 24AS may be selected to allow the bearing housing 20 to remain attached to the structure 17, and/or to allow the bearing housing 20 to separate from the structure 17, when they fracture in response to the off load on the bearing 21 exceeding the fracture load.

It will be understood that since the off load acting on the bearing 21 may have various components (i.e. radial, axial, and circumferential, in any combination), it follows that the displacement of the bearing housing 20 relative to the structure 17 caused by the off load after fracturing of the sacrificial bolts 36 may also have various components (i.e. radial, axial, and circumferential, in any combination). For example, a common off load that is expected to act on the bearing 21 during an adverse engine event is a significant torque caused by bearing seizure. The torque will cause the sacrificial bolts 36 to fracture by shearing in a plane perpendicular to the longitudinal axis of the shaft 32 of the sacrificial bolt 36, as shown in FIGS. 4A and 4B. The bearing housing 20 may then circumferentially displace relative to the structure 17 after fracturing of the sacrificial bolts 36. If the off load has a substantial radial component, it may cause the sacrificial bolts 36 to fracture by shearing in a plane perpendicular to the longitudinal axis of the shaft 32 of the sacrificial bolt 36, such that the bearing housing 20 displaces radially relative to the structure 17 after fracturing of the sacrificial bolts 36. If the off load has a substantial axial component, it may cause the sacrificial bolts 36 to fracture under tension applied along a direction parallel to the longitudinal axis of the shaft 32, and the bearing housing 20 may then axially displace relative to the structure 17.

Referring to FIGS. 3 to 4C, there is disclosed a method of securing the bearing housing 20 to the structure 17. The method may be performed during an initial assembly of the gas turbine engine 10. The method may be performed when repairing or replacing the bearing housing 20 of an already-assembled gas turbine engine 10, such as when servicing the gas turbine engine 10 in the aftermarket. The method includes supporting the rotatable shaft 11A with the bearing 21 of the bearing housing 20. The method includes placing the bearing housing 20 against the structure 17 to align mounting holes 24AH of the bearing housing 20 with mounting holes 19A of the structure 17, and to align mounting slots 24AS of the bearing housing 20 with other mounting holes 19A of the structure. The method includes inserting a first group of fasteners 30 through aligned pairs of the mounting holes 24AH,19A, inserting a second group of fasteners 30 through aligned pairs of the mounting slots 24AS and the other mounting holes 19A. The method includes tightening the first and second group of fasteners 30 to secure the bearing housing 20 to the structure 17. The first group of fasteners 30 is configured to fracture in response to a load on the bearing housing 20 exceeding the fracture load of the first group of fasteners 30. The bearing housing 20 is displaceable relative to the structure 17 after fracture of the first group of fasteners 30 via the second group of fasteners 30 moving within and relative to respective ones of the mounting slots 24AS.

The bearing housing 20 and method disclosed herein allow for the use of sacrificial bolts 36 to mitigate different failure cases (e.g. blade-off loads, bearing seizure, etc.). Since the bolts 30 are components needed to join the bearing housing 20 to the structure 17 in any event, the designation or purposing of one or more of these bolts 36 to fracture at different failure cases eliminates the need to increase the part count, and thus weight, of the bearing housing 20 to manage these failure cases. The bearing housing 20 and method disclosed herein helps to provide a "two-phase" failure mode using the existing bolts 30 by modifying the geometry of the bearing housing flanges 24 so that some of the bearing housing flange openings 24A are slots 24AS. This allows the bolts 30 to fracture in two stages, if needed, when the bearing housing 20 experiences a significant torque or other off load from a seizure of the bearing 21.

The embodiments described in this document provide non-limiting examples of possible implementations of the present technology. Upon review of the present disclosure, a person of ordinary skill in the art will recognize that changes may be made to the embodiments described herein without departing from the scope of the present technology. Yet further modifications could be implemented by a person of ordinary skill in the art in view of the present disclosure, which modifications would be within the scope of the present technology.

The invention claimed is:

1. A gas turbine engine mountable with engine mounting pads, the gas turbine engine comprising:

a structure linked to the engine mounting pads and having attachment flanges distributed circumferentially about a center axis of the gas turbine engine, each attachment flange having an attachment flange opening;

a bearing housing mounted to the structure and including a bearing supporting a rotatable shaft of the gas turbine engine, the bearing housing having bearing housing flanges distributed circumferentially about the center axis of the gas turbine engine, each bearing housing flange having a bearing housing flange opening aligned with the attachment flange opening of an attachment flange of the attachment flanges, some of the bearing housing flange openings being slots extending circumferentially about the center axis of the gas turbine engine, each slot having a circumferential dimension greater in magnitude than a radial dimension; and fasteners including a first group of the fasteners and a second group of the fasteners different from the first group of the fasteners, each fastener of the first group of the fasteners extending through one of the attachment flange openings and through one of the bearing housing flange openings aligned with that attachment flange opening, each fastener of the second group of the fasteners extending through one of the attachment flange openings and through one of the slots aligned with that attachment flange opening, the first group of the fasteners being sacrificial fasteners defining a fracture load indicative of a resistance of the sacrificial fasteners to fracture, the sacrificial fasteners configured to fracture in response to a load on the bearing housing exceeding the fracture load, the bearing housing being displaceable relative to the structure after fracture of the sacrificial fasteners via the second group of the fasteners moving within and relative to respective ones of the slots, wherein the sacrificial fasteners include the second group of the fasteners, the sacrificial fasteners of the second group of the fasteners defining a second fracture load indicative of a resistance of the sacrificial fasteners of the second group of the fasteners to fracture.

2. The gas turbine engine of claim 1, wherein the sacrificial fasteners of the second group of the fasteners are configured to fracture in response to the load on the bearing housing displacing the sacrificial fasteners of the second group of the fasteners to edges of the respective ones of the slots to shear the sacrificial fasteners of the second group of the fasteners.

3. The gas turbine engine of claim 1, wherein a number of the sacrificial fasteners of the first group of fasteners is equal to a number of the sacrificial fasteners of the second group of fasteners.

4. The gas turbine engine of claim 1, wherein the slots are circumferentially spaced apart from each other about the center axis and along a circumference of the bearing housing.

5. The gas turbine engine of claim 1, wherein the slots are circumferentially spaced apart from each other about the center axis by an angle, the angle being the same between adjacent circumferentially-spaced slots.

6. The gas turbine engine of claim 1, wherein the bearing housing flange openings are circumferentially spaced apart from each other about the center axis by an angle, the angle being the same between adjacent circumferentially-spaced bearing housing flange openings.

7. The gas turbine engine of claim 1, wherein the bearing housing is displaceable relative to the structure without experiencing plastic deformation.

8. The gas turbine engine of claim 1, wherein the fasteners are bolts.

9. The gas turbine engine of claim 1, wherein a symmetry plane extends through the center axis, through a first one of the bearing housing flange openings, and through a second one of the bearing housing flange openings circumferentially opposite to that first bearing housing flange opening, the bearing housing flange openings on one side of the symmetry plane being symmetrically disposed with the bearing housing flange openings on the other side of the symmetry plane.

10. The gas turbine engine of claim 1, wherein a remainder of the bearing housing flange openings are holes, each fastener of the first group of the fasteners extending through one of the attachment flange openings and through one of the holes aligned with that attachment flange opening.

11. The gas turbine engine of claim 10, the sacrificial fasteners of the first group of the fasteners secured in the holes and the sacrificial fasteners of the second group of the fasteners secured in the slots, the sacrificial fasteners of the first group of the fasteners in the holes configured to fracture before the sacrificial fasteners of the second group of the fasteners in the slots.

12. The gas turbine engine of claim 11, wherein the sacrificial fasteners of the second group of the fasteners in the slots are configured to fracture in response to the displacement the bearing housing circumferentially relative to the structure.

13. The gas turbine engine of claim 10, wherein the slots and the holes are disposed in alternating circumferential sequence about the center axis of the gas turbine engine.

14. The gas turbine engine of claim 10, wherein there is a first number of holes and a second number of slots, the first number being equal to the second number.

15. A method of securing a bearing housing to a structure of a gas turbine engine linked to engine mounting pads, the method comprising:

supporting a rotatable shaft of the gas turbine engine with a bearing of the bearing housing;

placing the bearing housing against the structure to align mounting holes of the bearing housing with mounting holes of the structure, and to align mounting slots of the bearing housing with other mounting holes of the structure; and inserting a first group of fasteners through aligned pairs of the mounting holes, inserting a second group of fasteners through aligned pairs of the mounting slots and the other mounting holes, and tightening the first and second group of fasteners to secure the bearing housing to the structure, the first group of fasteners configured to fracture in response to a load on the bearing housing exceeding a fracture load of the first group of fasteners, the bearing housing being displaceable relative to the structure after fracture of the first group of fasteners via the second group of fasteners moving within and relative to respective ones of the mounting slots, and wherein the inserting the second group of fasteners includes inserting the second group of fasteners to shear simulataneously in response to movement of the second group of fasteners against edges of the mounting slots after the first group of fasteners has fractured.

16. The method of claim 15, wherein inserting the first group of fasteners includes inserting the first group of fasteners to fracture simultaneously in response to the load on the bearing housing exceeding the fracture load of the first group of fasteners.

17. The method of claim 15, wherein inserting the first group of fasteners includes inserting the first group of fasteners to fracture simultaneously in response to the load on the bearing housing exceeding the fracture load of the first group of fasteners, the bearing housing remaining attached to the structure via the second group of fasteners in aligned pairs of the mounting slots and the other mounting holes.

18. The method of claim 15, wherein inserting the first group of fasteners includes inserting the first group of fasteners in the aligned pairs of the mounting holes to fracture simultaneously in response to the load on the bearing housing exceeding the fracture load of the first group of fasteners.

19. The method of claim 18, wherein inserting the second group of fasteners to shear simultaneously includes inserting the second group of fasteners to shear simultaneously and separate the bearing housing from the structure.

20. A gas turbine engine mountable with engine mounting pads, the gas turbine engine comprising:

a structure linked to the engine mounting pads and having attachment flanges distributed circumferentially about a center axis of the gas turbine engine, each attachment flange having an attachment flange opening;

a bearing housing mounted to the structure and including a bearing supporting a rotatable shaft of the gas turbine engine, the bearing housing having bearing housing flanges distributed circumferentially about the center axis of the gas turbine engine, each bearing housing flange having a bearing housing flange opening aligned with the attachment flange opening of an attachment flange of the attachment flanges, some of the bearing housing flange openings being slots extending circumferentially about the center axis of the gas turbine engine, each slot having a circumferential dimension greater in magnitude than a radial dimension; and fasteners including a first group of the fasteners and a second group of the fasteners different from the first group of the fasteners, each fastener of the first group of the fasteners extending through one of the attachment flange openings and through one of the bearing housing flange openings aligned with that attachment flange opening, each fastener of the second group of the fasteners extending through one of the attachment flange openings and through one of the slots aligned with that attachment flange opening, the first group of the fasteners being sacrificial fasteners defining a fracture load indicative of a resistance of the sacrificial fasteners to fracture, the sacrificial fasteners configured to fracture in response to a load on the bearing housing exceeding the fracture load, the bearing housing being displaceable relative to the structure after fracture of the sacrificial fasteners via the second group of the fasteners moving within and relative to respective ones of the slots, wherein the bearing housing is displaceable relative to the structure without experiencing plastic deformation.

* * * * *